US006769877B2

(12) United States Patent
Martin et al.

(10) Patent No.: US 6,769,877 B2
(45) Date of Patent: Aug. 3, 2004

(54) UNDERCUT LEADING EDGE FOR COMPRESSOR BLADES AND RELATED METHOD

(75) Inventors: Nicholas Francis Martin, Simpsonville, SC (US); James Charles Gautreau, Greenville, SC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/065,453

(22) Filed: Oct. 18, 2002

(65) Prior Publication Data

US 2004/0076521 A1 Apr. 22, 2004

(51) Int. Cl.[7] ..... F01D 5/30

(52) U.S. Cl. ..... 416/193 A; 416/219 R; 29/889.21

(58) Field of Search ..... 416/193 A, 219 R, 416/220 R, 500, 145, 221, 189; 29/889.21, 889.2

(56) References Cited

U.S. PATENT DOCUMENTS

| | | | | |
|---|---|---|---|---|
| 2,913,221 | A | | 11/1959 | Klint et al. |
| 2,994,507 | A | * | 8/1961 | Keller et al. |
| 4,221,542 | A | * | 9/1980 | Acres et al. ..... 416/220 R |
| 4,682,935 | A | | 7/1987 | Martin |
| 4,872,810 | A | * | 10/1989 | Brown et al. ..... 416/145 |
| 5,123,813 | A | * | 6/1992 | Przytulski et al. ..... 416/221 |
| 5,256,035 | A | * | 10/1993 | Norris et al. ..... 416/220 R |
| 5,277,548 | A | * | 1/1994 | Klein et al. ..... 416/193 A |
| 5,536,143 | A | | 7/1996 | Jacala et al. |
| 5,573,377 | A | | 11/1996 | Bond et al. |
| 5,582,077 | A | * | 12/1996 | Agram et al. ..... 74/573 R |
| 5,924,843 | A | | 7/1999 | Staub et al. |
| 6,033,185 | A | | 3/2000 | Lammas et al. |
| 6,065,938 | A | | 5/2000 | Barsch |
| 6,095,750 | A | | 8/2000 | Ross et al. |
| 6,132,174 | A | | 10/2000 | Staub et al. |
| 6,190,131 | B1 | | 2/2001 | Deallenbach |
| 6,402,471 | B1 | | 6/2002 | Demers et al. |
| 6,419,753 | B1 | | 7/2002 | Wheat et al. |
| 6,457,942 | B1 | | 10/2002 | Forrester |
| 6,478,537 | B2 | | 11/2002 | Junkin |
| 2002/0081205 | A1 | | 6/2002 | Wong |

FOREIGN PATENT DOCUMENTS

| | | |
|---|---|---|
| CH | 660207 A5 | 3/1987 |
| JP | 57076208 A | 5/1982 |

* cited by examiner

*Primary Examiner*—Edward K. Look
*Assistant Examiner*—J. M. McAleenan
(74) *Attorney, Agent, or Firm*—Nixon & Vanderhye P.C.

(57) ABSTRACT

A compressor blade includes an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion.

13 Claims, 1 Drawing Sheet

UNDERCUT LEADING EDGE FOR COMPRESSOR BLADES AND RELATED METHOD

BACKGROUND OF INVENTION

This invention relates generally to compressor blades, and specifically, to the provision for an undercut radially inward of the leading edge of the airfoil portion of the blade.

In large gas turbines used for generating electricity, power companies regularly water wash the machines as soon as any performance degradation is noticed. The water wash is sprayed into the machine at the compressor end, near the hub, and the fluid is flung out into the flow path, cleaning the compressor blades. As a result of this water wash, the first stage blades experience significant erosion along their leading edges, especially at the hub of the airfoil, i.e., where the airfoil meets the platform. This leading edge erosion reduces the high cycle fatigue capability of the material and, in the presence of vibratory excitation, may lead to blade failure.

Accordingly, there is a need to create a more erosion tolerant blade by lowering the mean and vibratory stress at the leading edge of the airfoil portion of the blade.

SUMMARY OF INVENTION

In accordance with an exemplary embodiment of this invention, attachment material (i.e., material in the root portion of the blade used to secure the blade to the compressor rotor or wheel) directly below, or radially inward of, the blade leading edge is removed. This creates an undercut below the blade platform and the leading edge of the blade. In other words, the blade leading edge and the front of the blade platform overhangs the attachment portion. The gap or space created by the material removal may be filled, if necessary, with a discrete spacer. The undercut arrangement effectively unloads the leading edge of the blade, thereby reducing the local mean and vibratory stresses along the leading edge.

Accordingly, in its broader aspects, the present invention relates to a compressor blade comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion.

In another aspect, the invention relates to a compressor blade comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion; wherein, when assembled on a compressor wheel, a void created by the undercut is filled by a spacer; and wherein the undercut has a depth of from about 0.5" to about 1.0".

In still another aspect, the invention relates to a method of unloading a leading edge of an airfoil portion of a compressor blade comprising: a) providing a blade having an airfoil portion with a leading edge, a platform, and an attachment portion adapted to secure the blade to a compressor wheel; and b) removing material from the attachment portion to create an undercut radially inward of the leading edge of the airfoil portion.

The invention will now be described in conjunction with the single drawing FIGURE identified below.

DETAILED DESCRIPTION

Figure 1:
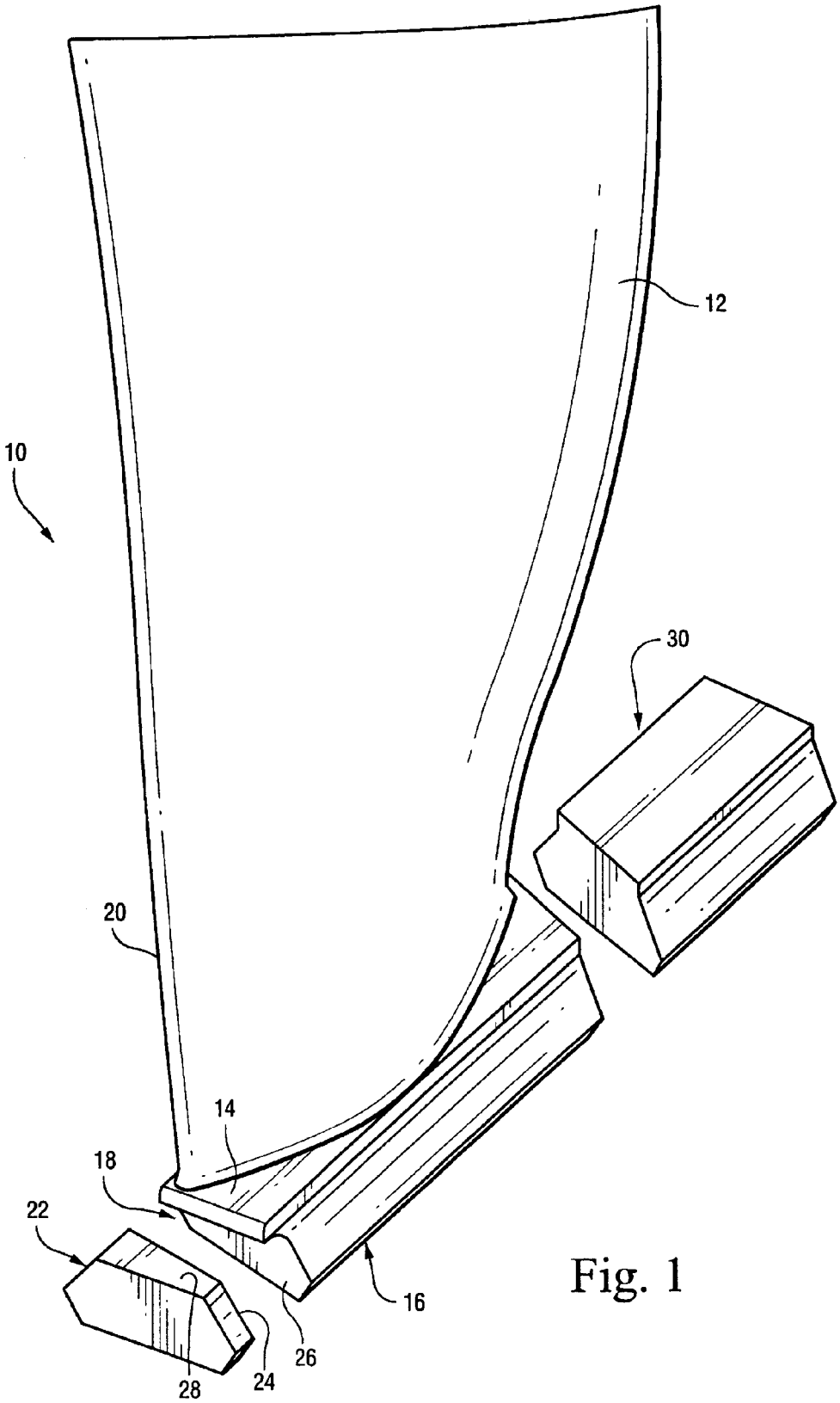
FIG. 1 is an exploded view of a compressor blade with an undercut leading edge, and also showing front and rear spacer components.

With respect to FIG. 1, a compressor blade 10 includes an airfoil portion (or simply, airfoil) 12, a platform 14; and an attachment or root portion 16 that typically is formed with a dovetail configuration that enables the blade to be loaded onto the compressor wheel or rotor (not shown). Material has been removed from and along the front face of attachment portion 16 beneath the platform and through the radial thickness of the attachment portion, thereby creating an undercut 18 radially inward of the platform 14 and the leading edge 20 of the airfoil 12. A spacer 22 may be used to fill in the undercut if necessary, and it will be understood that the spacer 22 may comprise the very same material removed from the blade 10 (that created the undercut 18), or the spacer may be manufactured as a separate component of the same or different material, and formed to substantially match the configuration of the undercut. In other words, the spacer may be used to fill the void created by the undercut, with the rearward flat surface 24 of the spacer abutting the flat forward face 26 of the attachment portion 16, and with a top surface 28 slightly spaced from the underside of the platform 14. It is then also used to hold the blade 10 in place when the blade is staked to the compressor wheel. A conventional rear spacer 30 may be employed at the rear side of the blade, i.e., in loading the blade onto the wheel, rear spacer 30 is loaded first, then the blade 10, and then the front spacer 22.

The depth of the undercut, i.e., the extent of the undercut in a circumferential direction (relative toe compressor wheel), as determined by the thickness of the removed material, may vary between about ½ inch to as much as 1 inch. The depth of the undercut must be sufficient to offload the leading edge of the blade, but must not be so great as to negatively effect the loading of the blade as a whole.

Creating the undercut 18 effectively unloads the leading edge of the blade, and allows the blade to sustain considerably more damage without exceeding the material capability. The erosion process creates small cracks in the leading edge of the blade.

When the crack length exceeds a propagation threshold value, the blade fails. In a conventional blade with a fully supported leading edge, this edge becomes the life limiting location. Undercutting the blade in accordance with this invention eliminates this concern. Consequently, the cracks created by the water washing will no longer propagate and endanger the machine. The leading edge of the blade will simply erode with time.

With the above arrangement, a more erosion tolerant blade is achieved by lowering the mean and vibratory stress at the leading edge of the blade.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A compressor blade comprising an airfoil portion having a leading edge, a radially inner attachment portion, and a platform between the airfoil portion and the attachment portion, wherein material is removed from and along a front face of the attachment portion beneath the platform and through the radial thickness of the attachment portion to form an undercut at a front face thereof to thereby provide an overhang radially inward of the platform and leading edge of the airfoil portion sufficient to reduce mean and vibratory stress where said leading edge meets said platform.

2. The compressor blade of claim 1 wherein the spacer comprises a discrete component constructed of the same or different material as the attachment portion.

3. The compressor blade of claim 1 wherein the undercut extends in a circumferential direction at least to the leading edge of the airfoil portion.

4. A compressor blade comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion wherein the spacer comprises the material removed from the attachment portion.

5. A compressor blade comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion wherein the undercut has a depth of from about 0.5" to about 1.0".

6. A compressor blade comprising an airfoil portion having a leading edge, a radially inner attachment portion, and a platform between the airfoil portion and the attachment portion, wherein material is removed from the attachment portion to form an undercut at a front face thereof to thereby provide an overhang radially inward of the platform and leading edge of the airfoil portion; wherein, when assembled on a compressor wheel, a void created by the undercut is filled by a spacer; and wherein the undercut has a depth of from about 0.5" to about 1.0".

7. The compressor blade of claim 6 wherein the spacer comprises the material removed from the attachment portion.

8. The compressor blade of claim 6 wherein the spacer comprises a discrete component constructed of the same or different material as the attachment portion.

9. A method of unloading a leading edge of an airfoil portion of a compressor blade comprising:

a. providing a blade having an airfoil portion with a leading edge, a platform, and an attachment portion adapted to secure the blade to a compressor wheel; and b. removing material from and along a front face of the attachment portion to create an undercut radially inward of the leading edge of the airfoil portion sufficient to reduce mean and vibratory stress where said leading edge meets said platform.

10. The method of claim 9 wherein the spacer comprises a discrete component constructed of the same or different material as the attachment portion.

11. The method of claim 9 wherein the undercut extends in a circumferential direction at least to the leading edge of the airfoil portion.

12. A method of unloading a leading edge of an airfoil portion of a compressor blade comprising:

a. providing a blade having an airfoil portion with a leading edge, a platform, and an attachment portion adapted to secure the blade to a compressor wheel; and b. removing material from the attachment portion to create an undercut radially inward of the leading edge of the airfoil portion wherein the spacer comprises the material removed from the attachment portion.

13. A method of unloading a leading edge of an airfoil portion of a compressor blade comprising:

a. providing a blade having an airfoil portion with a leading edge, a platform, and an attachment portion adapted to secure the blade to a compressor wheel; and b. removing material from the attachment portion to create an undercut radially inward of the leading edge of the airfoil portion wherein the undercut has a depth of from about 0.5" to about 1.0".

* * * * *